US012145699B2

(12) United States Patent
Erickson

(10) Patent No.: US 12,145,699 B2
(45) Date of Patent: Nov. 19, 2024

(54) PULL-BEHIND WATERCRAFT ACCESSORY DEVICE WITH STABILIZER FIN

(71) Applicant: Joshua Erickson, Wolverton, MN (US)

(72) Inventor: Joshua Erickson, Wolverton, MN (US)

( * ) Notice: Subject to any disclaimer, the term of this patent is extended or adjusted under 35 U.S.C. 154(b) by 546 days.

(21) Appl. No.: 17/539,529

(22) Filed: Dec. 1, 2021

(65) Prior Publication Data

US 2022/0177083 A1 Jun. 9, 2022

Related U.S. Application Data

(60) Provisional application No. 63/120,880, filed on Dec. 3, 2020.

(51) Int. Cl.
*B63B 39/06* (2006.01)

(52) U.S. Cl.
CPC ..... *B63B 39/06* (2013.01)

(58) Field of Classification Search
CPC ..... B63B 39/00; B63B 39/06; B63B 34/00; B63B 34/05; B63B 34/26; B63B 34/54; B63B 41/00
USPC ..... 114/126, 127, 132, 162, 164, 165
See application file for complete search history.

(56) References Cited

U.S. PATENT DOCUMENTS 3,648,643 A * 3/1972 Murray ..... B63J 3/04 114/253
3,872,819 A * 3/1975 Pickens ..... B63H 19/02 440/9

* cited by examiner

*Primary Examiner* — Daniel V Venne
(74) *Attorney, Agent, or Firm* — Brennan, Manna & Diamond, LLC

(57) ABSTRACT

This present invention relates to a stabilizer fin which is designed to act as a rudder system for a towable floatation device. The stabilizer fin can be mounted to any conventional pull behind floatable device to keep the device tracking straighter as it is pulled through the water. The stabilizer fin assembly comprises a mounting plate that is moulded to fit to the shape of the rear of the floatable device, and a fin designed to be attached to the mounting plate. The fin pivots freely between vertical up and down positions. The fin is counterweighted in order for the fin to fall freely into the lowered or down position while in the water. The stabilizer fin ensures that the floatable device does not create unnecessary drag and eases the paddling process for a watercraft operator towing the floatable device.

18 Claims, 6 Drawing Sheets

PULL-BEHIND WATERCRAFT ACCESSORY DEVICE WITH STABILIZER FIN

CROSS-REFERENCE TO RELATED APPLICATION

The present application claims priority to, and the benefit of, U.S. Provisional Application No. 63/120,880, which was filed on Dec. 3, 2020 and is incorporated herein by reference in its entirety.

FIELD OF THE INVENTION

The present invention relates generally to the field of towable or pull-behind watercraft accessory devices. More specifically, the present invention relates to a towable or pull-behind kayak cooler stabilizer fin comprising a pivoting rudder and a mounting assembly to be attached to a towable kayak cooler. It is to be appreciated that while the present invention is described in association with a towable kayak cooler, the stabilizer fin to be described in detail hereinafter, is suited for any water pull-behind watercraft accessory device. The stabilizer fin comprises a mounting assembly, including a mounting bracket that attaches to the cooler to hold a fin that pivots to stabilize its direction of travel in the direction it is being towed. The stabilizer fin keeps the cooler straight and prevents it from diverting from the intended direction, while also ensuring it does not drag across the ground, get stuck or make contact with logs, sandbars, etc. Additionally, the stabilizer fin ensures that the motion of the kayak cooler does not slow down the towing kayak, and eases the paddling process of the operator as well. Accordingly, the present disclosure makes specific reference thereto. Nonetheless, it is to be appreciated that aspects of the present invention are also equally applicable to other like water towable applications, i.e. watercraft pull-behind devices and methods of manufacture.

BACKGROUND OF THE INVENTION

By way of background, various kinds of watercrafts are used by people for enjoying water sports and activities. Watercrafts, such as kayaks, canoes, stand-up paddleboards (SUPs), etc., are propelled by paddling to move across water. Kayaks, canoes, and SUPs are small, narrow boats, propelled by means of a single or double-bladed paddle, and can be used on any body of water, from quiet lakes to whitewater rivers. to the open ocean. Since kayaks, canoes, and SUPS are small and narrow in structure, it is often difficult to carry additional bulky items such as coolers for storing drinks, food items, camping gear, etc. Various pull-behind coolers are available in the market that can be attached to a kayak using a strap, and can be accessed when desired while kayaking.

When pulling a towable kayak cooler without a stabilizer fin, the cooler tracks from side to side, wherein the kayaker can feel the drag associated the towed device. The movement is felt when the tow line goes slack and then tightens as the kayak advances through the water. The motion and drag of the towed device slows down the towing kayak, making the operator paddle harder to keep up with other kayakers in their group. This creates inconvenience for the kayakers, and they may not be able to fully enjoy the kayaking experience. Additionally, the slowing down of the towing kayak due to the motion and drag of the attached portable coolers makes the paddling process difficult for kayakers, and makes kayaking a labor-intensive experience.

Additionally, while towing the cooler device, kayakers may find it difficult to adjust the direction of travel of the cooler in the direction of the kayak. Consequently, the cooler devices may easily get stuck in logs, sandbars, etc., thereby causing inconvenience to the kayakers.

Therefore, there exists a long felt need in the art for a device for allowing easy towing of kayak cooler devices while kayaking. There is also a long felt need in the art for a stabilizing means for kayak coolers, that prevents repeated slackening and tightening movement to a tow line connected to a pull-behind floating accessory device. Additionally, there is a long felt need in the art for a stabilizing device for kayak coolers that does not slow down the movement of the kayak. Moreover, there is a long felt need in the art for a stabilizing means that does not require the kayaker to paddle harder while operating kayaks and towing kayak coolers. Further, there is a long felt need in the art for a stabilizing means that enables kayakers to easily adjust the direction of the kayak cooler with the direction of the kayak. Furthermore, there is a long felt need in the art for a stabilizing means that prevents cooler devices from getting stuck in logs, sandbars, and the like. Finally, there is a long felt need in the art for a water stabilizer device for pull-behind floatable devices, that allows the watercraft operator pulling the floatation device to keep pace with his or her paddling group.

The subject matter disclosed and claimed herein, in one embodiment thereof, comprises a stabilizer fin designed to act as a rudder system for a towable kayak cooler and other pull-behind floatable devices. The stabilizer fin comprises: a mounting plate moulded to match the shape of a rear section of a kayak cooler, wherein the mounting plate is attached to the rear section using a rivet and a pair of eye bolts; the pair of eye bolts are present at opposing terminal ends of the mounting plate; a notch in the rear of the mounting plate; a raised portion on the mounting plate around the notched area to mount a fin; and, the fin is mounted using a removable pivot pin wherein the removable pivot pin passes through a pair of holes in the raised portion and through a hole in the fin. The fin is freely pivoting between a generally vertical "up" position and a generally vertical "down" position. The fin comprises a generally v-shaped front edge to reduce drag in the water. The fin keeps the pull-behind device straight, and prevents it and the towing watercraft from diverting from the intended direction.

In this manner, the novel stabilizer fin of the present invention accomplishes all of the forgoing objectives, and provides a relatively easy, convenient and efficient solution to stabilize the direction of travel of a pull-behind device attached to a watercraft, keeps the pull-behind device straight and prevents it from diverting from the intended direction. The towable device stabilizer fin of the present invention is also user friendly, as it does not slow down the towing watercraft, assists in maintaining the intended direction of the towing watercraft and ensures that the paddler of the towing watercraft does not have to work excessively to keep pace with the other paddlers. Additionally, the kayak cooler stabilizer fin ensures a wonderful kayaking experience for the users.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a stabilizer fin designed to act as a rudder system for a towable kayak cooler and other pull-behind floatable devices. The stabilizer fin comprises: a mounting plate molded to match the shape of a rear section of a kayak cooler, wherein the mounting plate is attached to the rear section using a rivet and a pair of eye bolts; the pair of eye bolts are present at opposing terminal ends of the mounting plate; a notch in the rear of the mounting plate; a raised portion on the mounting plate around the notched area to mount a fin; and, the fin is mounted using a removable pivot pin wherein the removable pivot pin passes through a pair of holes in the raised portion and through a hole in the fin. The fin is freely pivoting between a generally vertical "up" position and a generally vertical "down" position. The fin comprises a generally v-shaped front edge to reduce drag in the water. The fin keeps the pull-behind device straight and prevents it and the towing watercraft from diverting from the intended direction.

In a further embodiment of the present invention, a removably attached stabilizer fin designed to attach to a rear portion of a towable kayak cooler is disclosed that keeps the pull-behind device straight, and prevents same from diverting from the intended direction. The stabilizer fin comprises: a mounting plate; a handle; a fin; the mounting plate is fixed to the rear portion of the kayak cooler using fastening mechanisms such as eye bolts and rivets; a handle is attached to the eye bolts; the fin having a hole through which a removable pivot pin is passed to mount the fin to the mounting plate in a notched area such that the fin pivots freely back and forth from an "up" position to a "down" position. The stabilizer fin further comprises a counterweight in a lower section of the fin to bias the fin to the "down" position while the towable device is in the water.

The mounted fin, in the notched area of the present invention, pivots upward when making contact with the riverbed, lakebed, or any other obstacles in the water. The upward pivoting is actuated upon contact with an object and prevents the fin from digging into the riverbed or lakebed. The fin is further actuated to the "up" position when making contact with logs, sand bars or fishing lines.

In one embodiment, a method to reduce the drag of a pull-behind floatation device attached to a kayak is disclosed and comprises: attaching a stabilizer fin rudder system at a rear portion of a towable kayak cooler, the stabilizer fin rudder system having a mounting plate attached to the rear portion of the cooler using a rivet and a pair of eye bolts or any other threaded fasteners; mounting a fin in a notched area of the mounting plate using a removable pivot pin, wherein the mounted fin pivots freely in vertical directions and helps in reducing drag while maintaining an intended direction of movement.

The advantage of the kayak cooler stabilizer fin of the present invention is that it reduces drag of the towable kayak cooler, and allows a kayaker pulling the kayak cooler to keep pace with the kayaking group. The fin maintains direction of travel in the direction in which the kayak cooler is being towed, and keeps the cooler straight while preventing it from diverting from the intended direction. The stabilizer fin ensures that the motion of the pull-behind device does not slow down the towing kayak, and also eases the paddling process for the kayaker or operator towing the pull-behind device.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
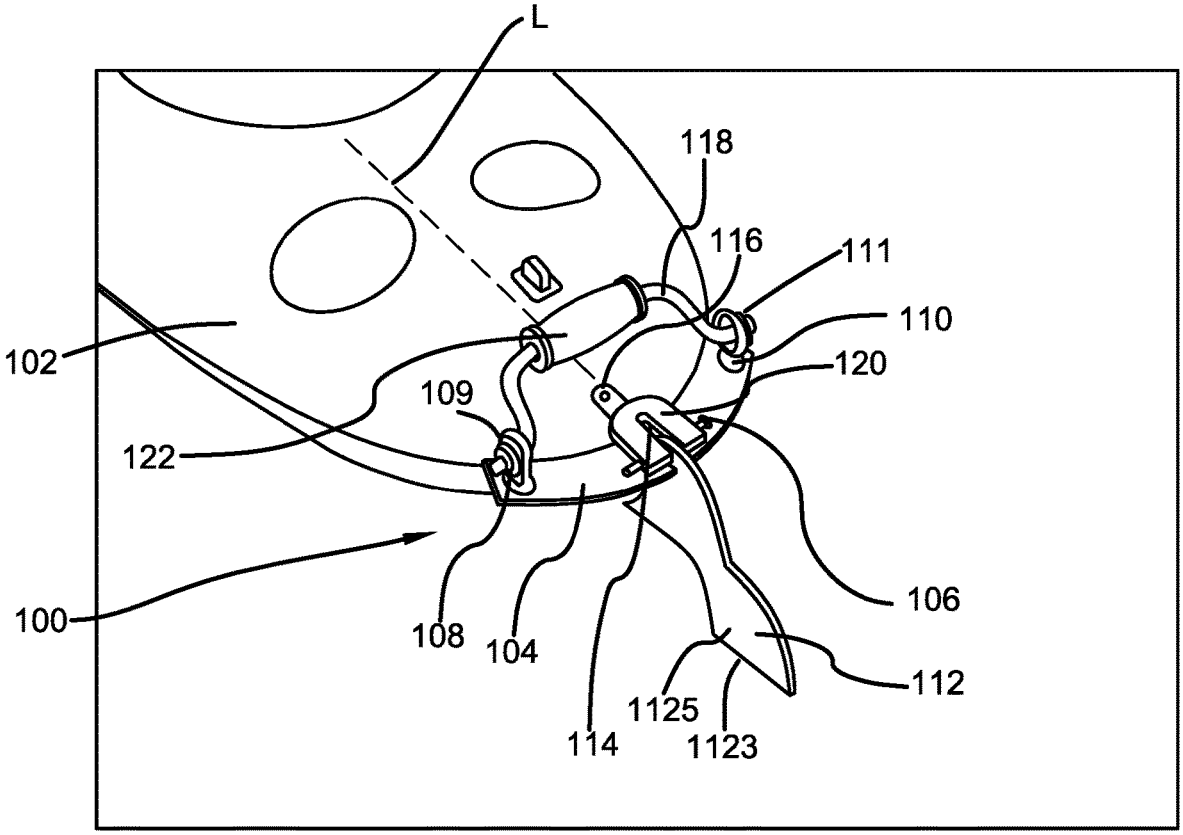
FIG. 1 illustrates a perspective view of one potential embodiment of the pull-behind watercraft accessory device of the present invention attached to a rear portion of a towable kayak cooler in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long felt need in the art for a device for allowing easy towing of pull-behind storage devices or kayak cooler devices while kayaking, canoeing or stand-up paddle boarding. There is also a long felt need in the art for a stabilizing means for kayak coolers which prevent slackening and tightening movements of the tow line connected to the kayak coolers. Additionally, there is a long felt need in the art for a stabilizing device for kayak coolers which does not slow down the movement of the towing watercraft. Moreover, there is a long felt need in the art for a stabilizing means which does not require kayakers to paddle harder while operating kayaks while towing kayak coolers. Further, there is a long felt need in the art for a stabilizing means which enables paddlers to easily adjust the direction of the kayak cooler with the direction of their watercraft. Furthermore, there is a long felt need in the art for a stabilizing means which prevents the cooler devices from getting stuck in logs, sandbars and the like. Finally, there is a long felt need in the art for a stabilizer device for conventional kayak coolers which allows the kayaker pulling the cooler to keep pace with his or her kayaking group.

The present invention, in one exemplary embodiment, is a novel kayak cooler stabilizer fin designed to act as a rudder system for a towable kayak cooler and other pull-behind floatable devices. The stabilizer fin comprises: a mounting plate molded to match the shape of a rear section of a kayak cooler wherein the mounting plate is attached to the rear section using a rivet and a pair of eye bolts; the pair of eye bolts are present at opposing terminal ends of the mounting plate; a notch in the rear of the mounting plate; a raised portion on the mounting plate around the notched area to mount a fin; and, the fin is mounted using a removable pivot pin wherein the removable pivot pin passes through a pair of holes in the raised portion and through a hole in the fin. The fin is freely pivoting between a generally vertical "up" position and a generally vertical "down" position. The fin comprises a generally v-shaped front edge to reduce drag in the water. The fin keeps the pull-behind device straight and prevents it and the towing watercraft from diverting from the intended direction.

Referring initially to the drawings, FIG. 1 illustrates a perspective view of one potential embodiment of the pull-behind watercraft accessory device 100 of the present invention in the form of a kayak cooler stabilizer fin in accordance with the disclosed architecture. As shown, the kayak cooler stabilizer fin 100 is attached to the rear portion of a kayak cooler 102. The mounting plate 104 of the kayak cooler stabilizer fin 100 is shaped and dimensioned to accommodate many standard sizes of kayak coolers 102, such that the mounting plate 104 can be attached using a raised portion 120.

A rivet 116 is used to attach the mounting plate 104 to the rear portion. To further support the mounting plate 104, a pair of eye bolts 108, 110 are used at the end of the mounting plate 104. The rivet 116 and the pair of eye bolts 108, 110 secure the mounting plate 104 in a secure and stable manner to the pull-behind device. The mounting plate 104 can comprise metal, rigid or heavy plastic material. To control the kayak cooler stabilizer fin 100, a handle 118 comprising rigid material and having an ergonomic grip 122 is pivotally-retained between the eye bolts 108, 110. It is to be appreciated that the handle 118 and grip 122 further provide a carry mechanism for carrying the pull-behind device when on dry land (i.e. taking the device into and from the water).

A fin 112 is used as a pivoting rudder, which keeps the towable kayak cooler 102 tracking straight, and prevents the towable kayak cooler 102 from diverting from the intended direction of the towing kayak. The fin 112 is aligned and centered with a centerline L of the pull-behind device. It is to be appreciated that the pivotal movement of the fin 112 is in the same plane as a plane running vertical through the centerline L of the pull-behind floatation device. A notch 114 is present in the rear of the mounting plate to allow for free movement of the fin 112. To mount the fin 112 in the notched area 114, a removable pivot pin 106 is used which passes through the raised portion 120 of the mounting bracket and through a hole 1124 in the fin 112. The fin 112 pivots freely from an "up" position to a "down" position. In the "down" position, the fin is generally below a deck line of the pull-behind device 102. The device 102 can pivot upwards when making contact with an obstruction, and then pivot back downward as the lower section 1125 of the fin 112 acts as a counterweight for the fin 112 to bias backward and downward to fall freely into the lowered position while in the water.

The mounting plate 104 securely fits to the rear portion of the kayak cooler 102 and supports the movement of the fin 112 effectively while traversing in the water and also during vertical up and down movement. The handle 118 is engaged with the eye bolts 108, 110 to provide a secure grip and attachment to the mounting plate 104. In place of the rigid handle 118, any rope or string can also be used for the same purpose. Both of the eye bolts 108, 110 have threaded shafts and nuts to secure the mounting plate 104 to the rear portion of the kayak cooler 102. Opposing retention rings 109, 111 are used to secure the handle 118 to the eye bolts 108, 110.

The mounting plate 104 may be secured to the rear portion of the pull-behind device 102 by mounting the rivet 116 and eye bolts 108, 110 to the rear of the pull-behind device 102. The pull-behind device stabilizer fin 100 enhances the stability of the pull-behind device 102 which is designed for the transportation and storage of essential survival items, camping gear, and other food and drink items.

A bottom surface of the mounting plate 104 adheres to the top surface of the kayak cooler 102, proximal to the rear edge of the kayak cooler 102, in the attached arrangement. The fin 112 is removably attached to the mounting plate 104, and can be selectively attached using the pivot pin 106.

The kayak cooler stabilizer fin 100 provides convenience to a kayak operator and ensures that the motion of the kayak cooler 102 does not slow down the towing kayak, and eases the paddling process for the operator. The kayak cooler stabilizer fin 100 forms a rudder assembly which can be easily mounted to the rear section of the towable kayak cooler.

To install the kayak cooler stabilizer fin 100 at the rear of the kayak cooler 102, an operator places the mounting plate 104 along the kayak cooler's rear deck. The operator then secures the rivet 116, eye bolts 108, 110 (with nuts), and mounting bracket 120 to thereby retain the mounting plate 104 and the handle 118. The mounting plate 104 extends rearwardly from the deck line of the rear section of the kayak cooler 102. The fin 112 is then attached using the removable pivot pin 106 for a complete and effective rudder system.

Figure 2:
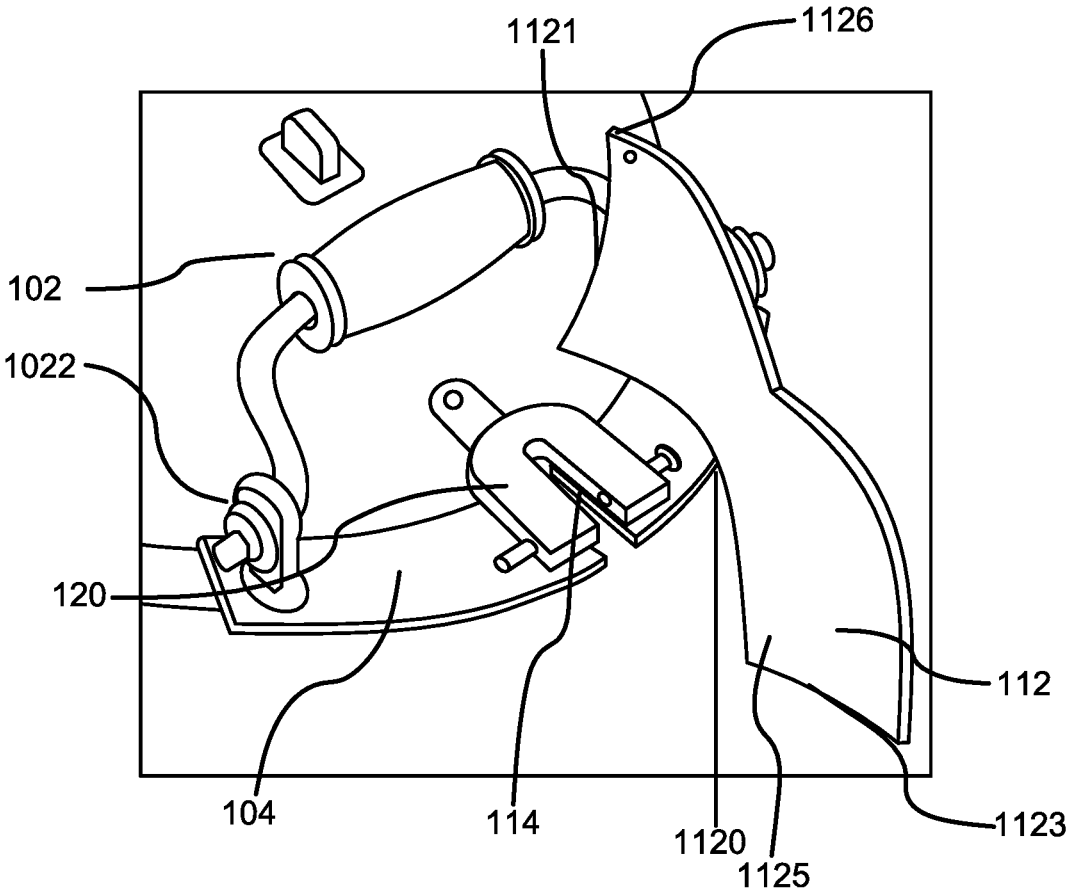
FIG. 2 illustrates a perspective view of one potential embodiment of the fin portion of the pull-behind watercraft accessory device of the present invention being mounted over a raised portion in accordance with the disclosed architecture.

FIG. 2 illustrates a perspective view of one potential embodiment of the fin portion 112 of the pull-behind watercraft accessory device 100 of the present invention being mounted over a raised portion in accordance with the disclosed architecture. As shown, the mounting plate 104 is attached to the rear end 1022 of the kayak cooler 102. The fin 112, including a mounting edge 1121, can be inserted into the notch 114 of the mounting plate 104, such that the top end 1126 of the fin 112 is positioned on the mounting plate 104 in a manner that a pivot pin 106 can be passed through a hole 1124 on the fin 112 and side holes 402 of the raised portion 120. The pivot pin 106 can be secured by a nut at one end, or any other fastening mechanism to secure the fin 112 within the notch 114 of the mounting plate 104.

Figure 3:
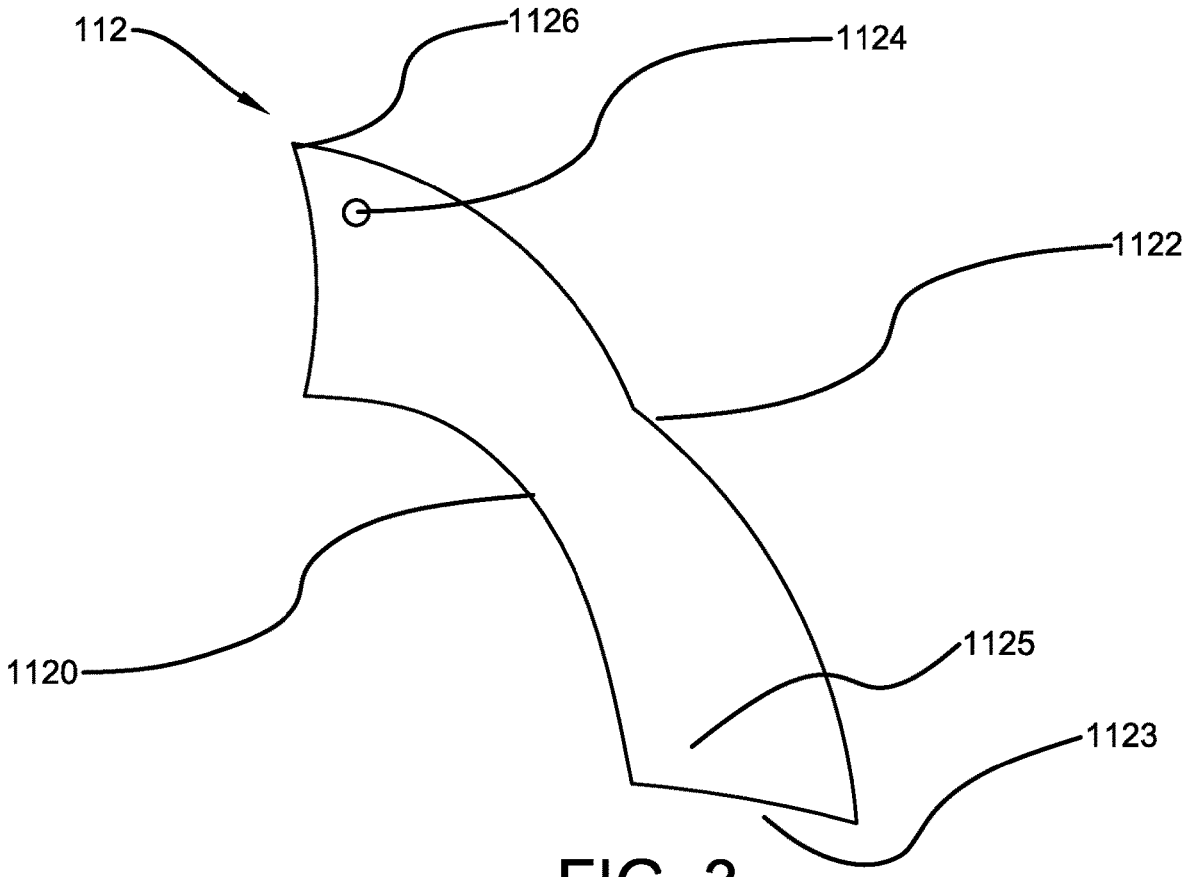
FIG. 3 illustrates a perspective view of one potential embodiment of the fin portion of the pull-behind watercraft accessory device of the present invention in accordance with the disclosed architecture.

FIG. 3 illustrates a perspective view of one potential embodiment of the fin portion 112 of the pull-behind watercraft accessory device 100 of the present invention in accordance with the disclosed architecture. More specifically, the fin 112 is a selectively attachable fin that can be secured to a mounting bridge via a removable pivot pin 106, and comprises a front v-shaped leading edge 1120 and a rear edge 1122. The fin 112 is designed such that it pivots freely from an up or stowed position to a down or deployed position. In the down position, the fin is generally below the deck line of the pull-behind device 102. The device 102 can pivot upwards when making contact with an obstruction, and then pivot back downward as the lower section 1125 of the fin 112 acts as a counterweight for the fin 112 to bias backward and downward, to fall freely into the lowered position while in the water. The v-shaped front edge 1120 reduces drag while the pull-behind device 102 traverses across the water. The fin 112 pivots upward while and when the bottom edge 1123 is being dragged across the ground to prevent digging in or getting stuck. Pivoting of the device can also occur when the fin 112 makes contact with logs, sand bars or fishing lines and the biasing is overcome.

A hole 1124 is present near a top end 1126 of the fin 112. The hole 1124 is used to pass the pivot pin 106 therethrough for mounting the fin 112 to the mounting plate 104. The hole 1124 is sized in accordance with a pair of side holes 402 on the mounting bridge. A removable pivot pin 106 passes through the hole 1126 to mount the fin 112 securely and in a stable manner to the mounting plate attached to the rear section of the towable kayak cooler 102.

Figure 4:
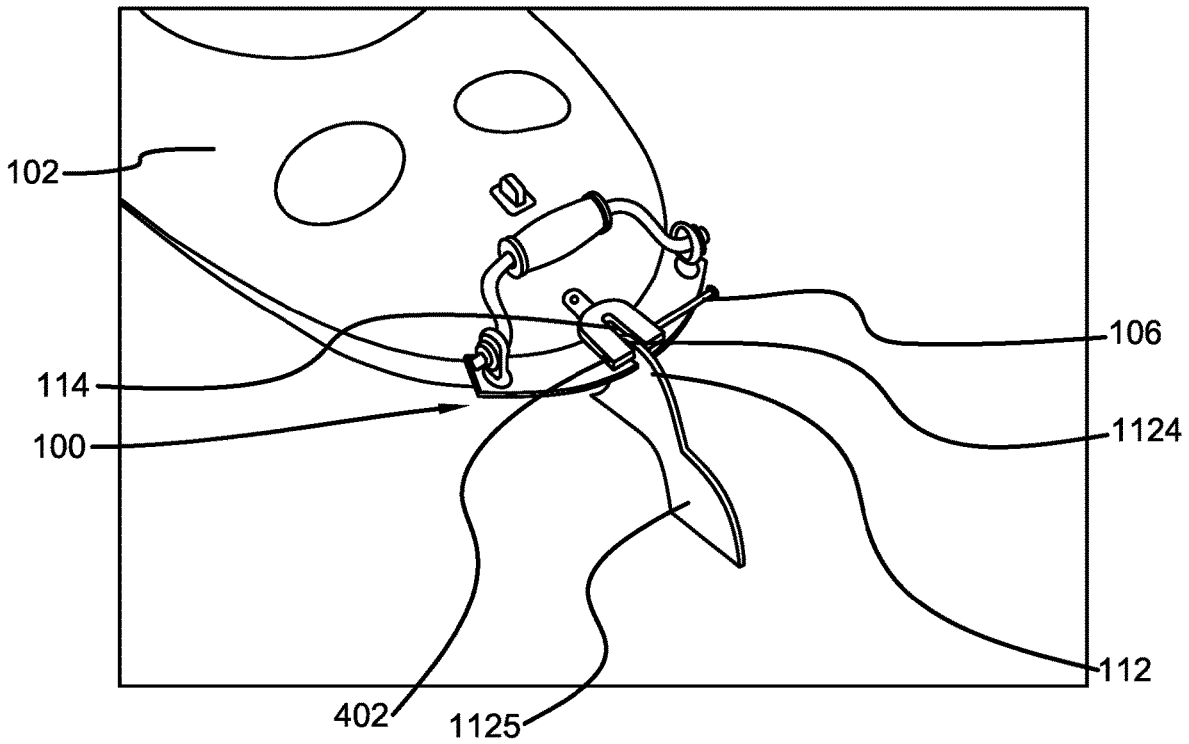
FIG. 4 illustrates a perspective view of one potential embodiment of the fin portion of the pull-behind watercraft accessory device of the present invention being mounted in accordance with the disclosed architecture.

FIG. 4 illustrates a perspective view of one potential embodiment of the fin portion 112 of the pull-behind watercraft accessory device 100 of the present invention being mounted in accordance with the disclosed architecture. More specifically, the fin 112 is mounted by positioning the same in the notch 114 so that the hole 1124 near the top end of the fin 112 aligns with a pair of side holes 402. Through the side holes 402 and the fin hole 1124, a removable pivot pin 106 is passed therethrough and is secured using a nut or any other fastening mechanism to secure the fin 112 within the notch 114. Once the fin 112 is secured, the fin 112 can pivot freely from an "up" position to a "down" position. When in the "up" position, the lower section 1125 of the fin acts as counterweight to the fin to bias the fin 112 to the "down" position and allow the fin 112 to fall freely into the lowered (i.e. down) position while in the water.

Figure 5:
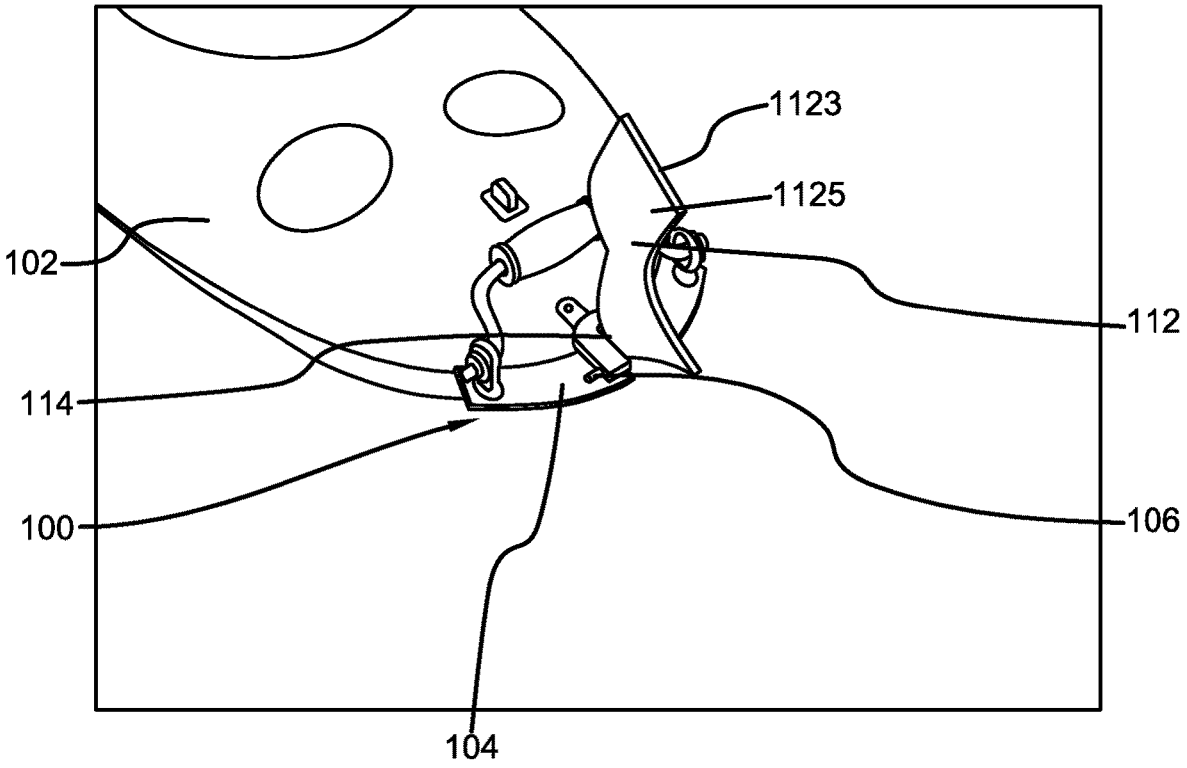
FIG. 5 illustrates a perspective view of one potential embodiment of the fin portion of the pull-behind watercraft accessory device of the present invention in a stowed position in accordance with the disclosed architecture.

FIG. 5 illustrates a perspective view of one potential embodiment of the fin portion 112 of the pull-behind watercraft accessory device 100 of the present invention in a stowed position in accordance with the disclosed architecture. The stabilizer fin 112, when mounted to the mounting plate 104 within the notch 114, pivots freely between a "down" position within the water and a vertically "up" position, as best shown in FIG. 5, wherein the pivoting pin 106 allows the fin 112 to pivot freely. As shown, the fin 112 pivots "up" while and when dragging the towable cooler across the ground or other surface to prevent damage to the fin. Pivoting also occurs when encountering other obstacles in the water such as, logs, sand bars or fishing lines. The movements of the fin 112 in the vertical up and down directions are smooth and do not impede the movement of the towable kayak cooler.

Figure 6:
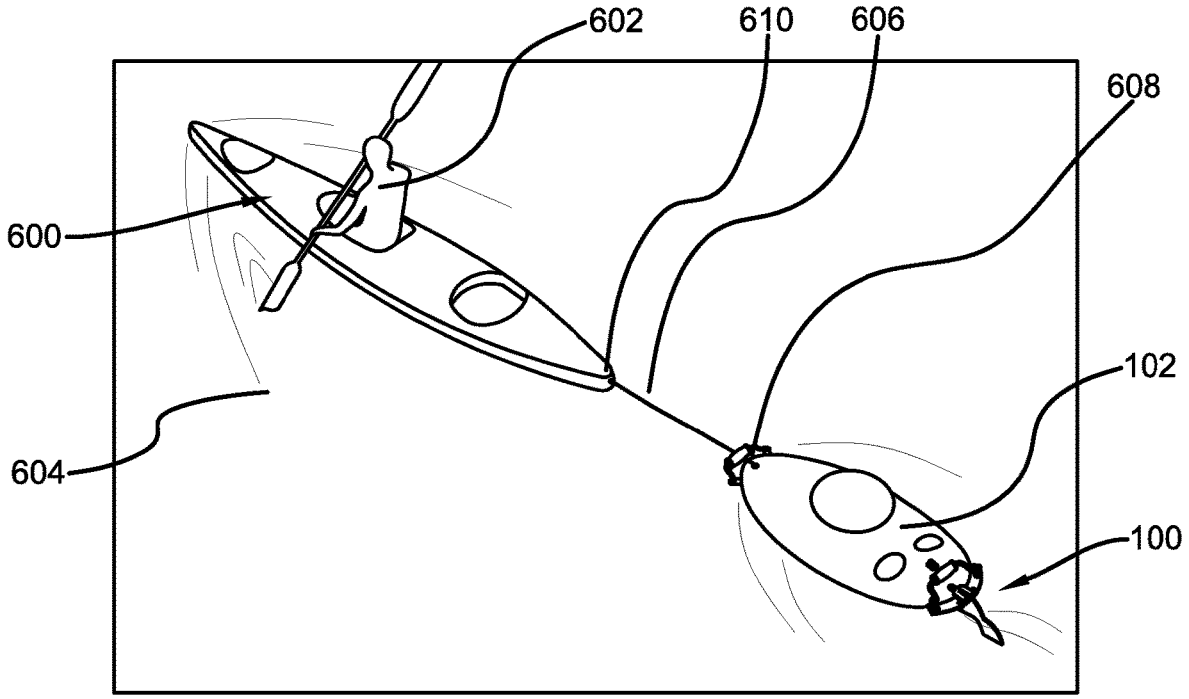
FIG. 6 illustrates a perspective view of one potential embodiment of a towable kayak cooler having the tow-behind watercraft accessory device of the present invention in accordance with the disclosed architecture, wherein the towable kayak cooler is being towed by a user in a kayak.

FIG. 6 illustrates a perspective view of one potential embodiment of a towable kayak cooler 102 having the tow-behind watercraft accessory device 100 of the present invention in accordance with the disclosed architecture, wherein the towable kayak cooler 102 is being towed by a user or operator 602 in a kayak 600. More specifically, the kayak cooler stabilizer fin 100 is mounted to the kayak cooler 102 and helps to keep the cooler moving straight, and prevents the cooler 102 from diverting from the intended direction while also ensuring that the cooler 102 does not drag across the ground, get stuck, or get hung-up on logs, sandbars, etc. The cooler 102 is attached to a kayak 600 with a rope or string 606 connecting the front end 608 of the cooler 102 and the rear end 610 of the kayak 600. With the stabilizer fin 100 in place, an operator 602, while pulling the kayak cooler 102, can maintain a constant speed and not have to exert extra effort in order to paddle and keep up with other kayakers in their group.

The kayak cooler stabilizer fin 100 keeps the cooler 102 tracking straight and prevents the cooler 102 from diverting from the intended direction, thus making the kayak operation smooth, less tiring and more enjoyable for the operator 602. The fin 112 falls freely into the lowered position while in the water 604, and pivots vertically upward when contacting logs, sand bars or fishing lines. The kayak cooler stabilizer fin 100 helps in maneuvering the kayak cooler 102 across all water surfaces and provides for stable tracking behind kayaks, canoes, SUPS or rafts.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "kayak cooler stabilizer fin", "stabilizer fin", "stabilizer fin for a pull behind floatable device", and "stabilizer fin assembly" are interchangeable and refer to the pull behind device or kayak cooler stabilizer fin 100 of the present invention.

Notwithstanding the forgoing, the kayak cooler stabilizer fin 100 of the present invention can be of any suitable size and configuration as is known in the art without affecting the overall concept of the invention, provided that it accomplishes the above-stated objectives. One of ordinary skill in the art will appreciate that the size, configuration and material of the kayak cooler stabilizer fin 100 as shown in the FIGS. are for illustrative purposes only, and that many other sizes and shapes of the kayak cooler stabilizer fin 100 are well within the scope of the present disclosure. Although the dimensions of the kayak cooler stabilizer fin 100 are important design parameters for user convenience, the kayak cooler stabilizer fin 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A stabilizer fin for a pull behind floatable storage device, the stabilizer fin comprising:

a pivotable fin;

a mounting plate for mounting to a rear edge of the pull behind floatable storage device;

said mounting plate partially extends beyond a deck line of the pull behind floatable storage device;

a pivot pin for passing through a pair of mounting holes in said mounting plate and for passing through a hole in said pivotable fin for mounting said pivotable fin to said mounting plate;

said pivotable fin pivotable from an up position to a down position, wherein said pivotable fin is biased to said down position;

said pivotable fin pivots to said up position when said pivotable fin contacts an obstruction and the biasing is overcome; and said pivotable fin pivots to said down position when said pivotable fin is free from the obstruction and the biasing is not overcome.

2. The stabilizer fin of claim 1, wherein said pivotable fin comprises a counterweight in a lower section of said pivotable fin.

3. The stabilizer fin of claim 2, wherein said mounting plate comprises a pair of eye bolts for securing the mounting plate to the pull behind floatable storage device.

4. The stabilizer fin of claim 3, further comprising a handle mounted between said eye bolts.

5. The stabilizer fin of claim 4, wherein said pivotable fin comprises a v-shaped leading edge.

6. The stabilizer fin of claim 5, wherein said pivotable fin is aligned with a centerline of the pull behind floatable storage device.

7. A stabilizer fin for a pull behind floatable storage device, the stabilizer fin comprising:

a pivotable fin;

a mounting plate for mounting to a rear edge of the pull behind floatable storage device;

a pivot pin for passing through a pair of mounting holes in said mounting plate and for passing through a hole in said pivotable fin for mounting said pivotable fin to said mounting plate;

said pivotable fin comprises a counterweight in a lower section of said pivotable fin;

said pivotable fin pivotable from an up position to a down position, wherein said pivotable fin is biased to said down position;

said pivotable fin pivots to said up position when said pivotable fin contacts an obstruction and the biasing is overcome; and said pivotable fin pivots to said down position when said pivotable fin is free from the obstruction and the biasing is not overcome.

8. The stabilizer fin of claim 7, wherein said mounting plate partially extends beyond a deck line of the pull behind floatable storage device.

9. The stabilizer fin of claim 8, wherein said mounting plate comprises a pair of eye bolts for securing the mounting plate to the pull behind floatable storage device.

10. The stabilizer fin of claim 9, further comprising a handle mounted between said eye bolts.

11. The stabilizer fin of claim 10, wherein said pivotable fin comprises a v-shaped leading edge.

12. The stabilizer fin of claim 11, wherein said pivotable fin is aligned with a centerline of the pull behind floatable storage device.

13. A method to reduce drag of a pull behind floatation device attached to a watercraft, the method comprising:

attaching a stabilizer fin rudder system at a rear portion of the pull behind floatation device;

said stabilizer fin rudder system having a mounting plate attached to said rear portion of the pull behind floatation device, wherein said mounting plate includes a rivet and a pair of eye bolts for securing said mounting plate to the pull behind floatation device;

mounting a fin in a notch of said mounting plate using a selectively removable pivot pin;

aligning said fin with a centerline of the pull behind floatation device;

said mounted fin pivots freely up and down in vertical directions in a plane running vertically through said centerline; and said mounted fin is biased in a vertical down position.

14. The method of claim 13, wherein said fin comprises a counterweight in a lower section of said mounted fin.

15. The method of claim 14, further comprising a handle mounted between said eye bolts.

16. The method of claim 15, wherein said mounted fin comprises a v-shaped leading edge.

17. The method of claim 16, wherein said mounting plate partially extends beyond a deck line of the pull behind floatation device.

18. The method of claim 13, further comprising:

pivoting said mounted fin to an up position when said mounted fin contacts an obstruction and the biasing is overcome; and pivoting said mounted fin to a down position when said mounted fin is free from the obstruction and the biasing is not overcome.

* * * * *